United States Patent [19]

Smith et al.

[11] 4,045,705

[45] Aug. 30, 1977

[54] ELECTRON BOMBARDED SEMICONDUCTOR DEVICE

[75] Inventors: David H. Smith, San Jose; Richard I. Knight, Los Altos, both of Calif.

[73] Assignee: Watkins-Johnson Company, Palo Alto, Calif.

[21] Appl. No.: 697,224

[22] Filed: June 17, 1976

[51] Int. Cl.[2] ..... H01J 31/04

[52] U.S. Cl. ..... 315/3; 313/366; 330/43; 330/46

[58] Field of Search ..... 315/3; 313/366; 330/43, 330/44, 46; 307/308

[56] References Cited

U.S. PATENT DOCUMENTS

| | | | |
|---|---|---|---|
| 3,676,716 | 7/1972 | Hanrahan | 307/308 |
| 3,725,803 | 4/1973 | Yoder | 330/46 |
| 3,749,961 | 7/1973 | Bates et al. | 315/3 |
| 3,916,255 | 10/1975 | Crandall | 313/366 X |
| 3,922,616 | 11/1975 | Weiner | 330/44 |
| 4,001,600 | 1/1977 | Carter, Jr. | 315/3 X |

*Primary Examiner*—Eugene R. LaRoche
*Attorney, Agent, or Firm*—Flehr, Hohbach, Test, Albritton & Herbert

[57] ABSTRACT

An electron bombarded semiconductor amplifier with a simplified target construction where the common point of the diode array is returned to ground enabling the radio frequency bypassing capacitors to be made a smaller size and the dc blocking capacitors to be provided by separate capacitors outside of the vacuum envelope and also optimized.

4 Claims, 5 Drawing Figures

ELECTRON BOMBARDED SEMICONDUCTOR DEVICE

The invention herein described was made in the course of or under a contract or subcontract thereunder with the Office of Naval Research.

BACKGROUND OF THE INVENTION

The present invention is directed to an electron bombarded semiconductor device and more specifically to an improved amplifier of the above type with an inverted class B output circuit.

A conventional class B electron bombarded semiconductor (EBS) amplifier is illustrated schematically in FIG. 1 and in U.S. Pat. No. 3,749,961 assigned to the present assignee. The diodes D1 and D2 are illuminated during alternate halves of a radio frequency (RF) cycle by a deflected electron beam which is generated as shown in the above patent. By causing the addition of two half sine waves in the common output line there is formed a sinusoidal output voltage across the load $Z_L$. This load is of a 50 ohm impedance level and it is matched with the output signal at the common junction of the diodes by a impedance transformer network and a bandshaping network. RF choke coils are also provided in series with the battery sources.

The diodes are reverse biased by the respective dc voltage sources $V_{cc}$ which are tied together at ground, which is also the other terminal of the load $Z_L$ and a common connection for a pair of bypass capacitors $C_B$. These bypass capacitors provide a return path to ground for the radio frequency current flowing in the diodes, while blocking the dc bias supply currents. It is necessary that these capacitors be located physically close to the diodes in order to minimize effects due to propagation time which would lead to partial cancellation of the RF signal. The bypass capacitors also function in concert with the RF chokes to prevent radio frequency voltages from entering the dc bias supplies.

Thus, it is apparent that the bypass capacitors $C_B$ are required to accomplish many functions some of which are antithetical in nature.

To summarize the operation of an EBS circuit as set out in FIG. 1, during the quiescent position of the beam it impinges between the diode targets of D1 and D2 and no current flows in either diode. Deflection of the beam to the upper diode causes current to flow so that a positive polarity voltage is developed; deflecting the beam to the other target causes an opposite polarity. Current flowing in the diodes at any instant of time is proportional to the area of the diode which is illuminated by the beam. The diode and beam geometry is designed so that there exists a linear relationship between beam deflection and the output voltage generated across the load $Z_L$. The class B operation described above is advantageous in providing high efficiency linearity, and broad band frequency response.

OBJECTS AND SUMMARY OF THE INVENTION

It is, therefore, an object of the present invention to provide an improved electron bombarded semiconductor device.

In accordance with the above object there is provided an electron bombarded semiconductor device having an evacuated envelope. An electron gun is positioned at one end of the envelope to project an electron beam along the envelope in a predetermined path. Means are responsive to an input signal for deflecting the beam from the path. A target within the envelope comprises a pair of spaced semiconductor diode devices each having first and second regions of opposite conductivity types forming a p-n junction with a region adapted to receive the beam. The beam impinges between the devices when it is in its predetermined path and a region of one or the other of the diode devices when deflected responsive to the input signal. The target includes a common ground and means for connecting one region of each of the devices, but of opposite conductivity type, to the common ground. A load has one terminal connected to the common ground and the other ac coupled to the other regions of the diode devices. Means are provided for applying a unidirectional voltage between the common ground and the other regions to reverse bias the diode devices.

DETAILED DESCRIPTION OF THE PREFERRED EMBODIMENT

Figure 1:
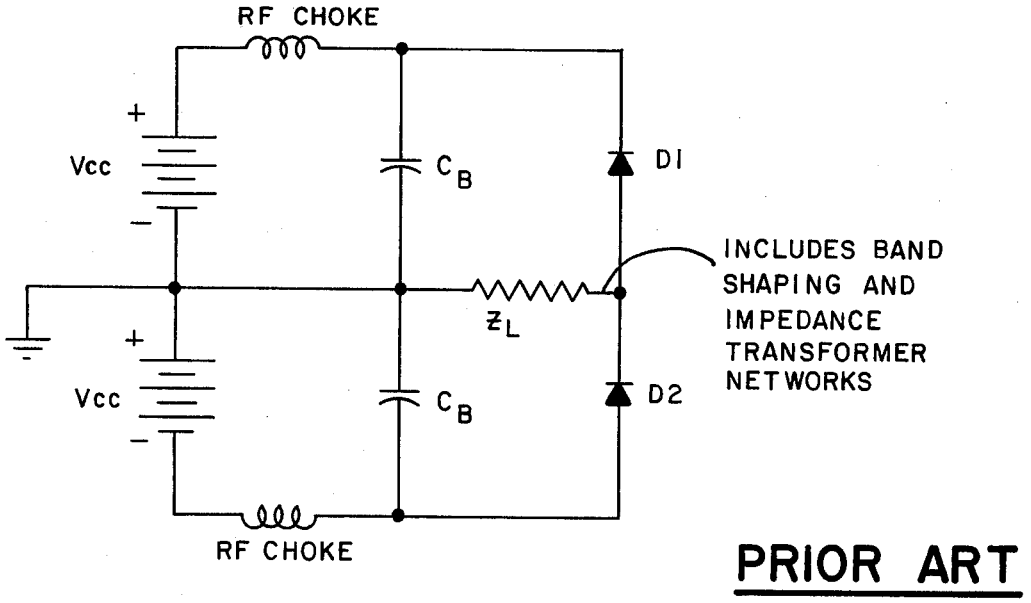
FIG. 1 is a schematic circuit diagram of a prior art EBS device.
Figure 2:
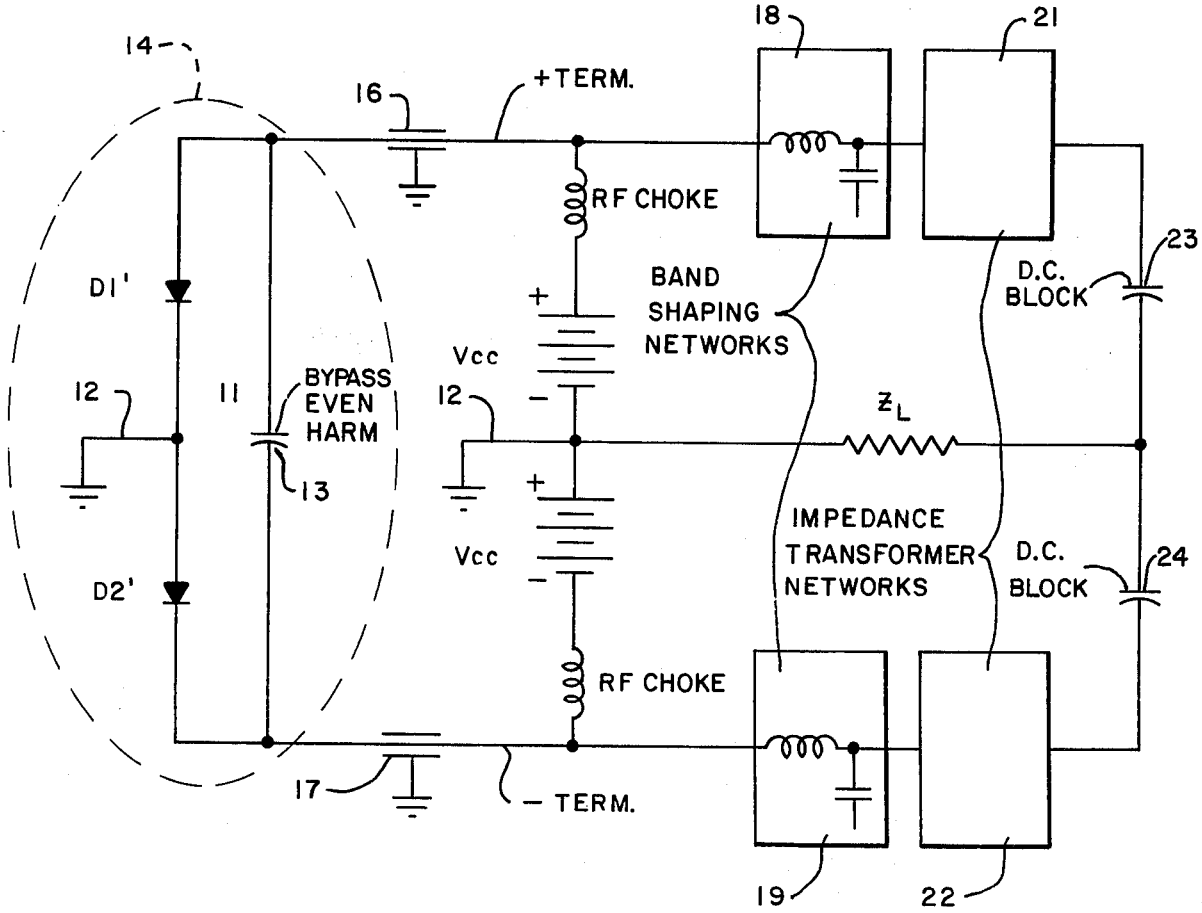
FIG. 2 is a schematic circuit diagram of the device of the present invention.

Referring to FIG. 2 the improved construction of the present invention includes the diodes D1' and D2' having their common junction point 11 returned to a common ground 12. The functions performed by the bypass capacitors $C_B$ in FIG. 1 are accomplished by capacitors 13 and the combination of 23 and 24. Antisymmetric components of the RF current flowing in the two diodes are effectively short circuited by the bridging or bypass capacitor 13. For balanced operation this includes all even harmonic and even order combination frequencies. This capacitor must be located physically close to the diodes in order to minimize effects due to propagation time. The capacitors 23 and 24 provide ac coupling of the symmetric components of these RF currents to the load, $Z_L$, and also block the dc voltage from the bias supplied from their common connection. Because these capacitors 23, 24 need not be physically close to the diodes, they may be placed external to the vacuum envelope. For class B or A-B operation only the fundamental frequency component is symmetric and as a result only this component is coupled to the load.

Both the diodes D1' and D2' and the bypass capacitor 13 are contained within the evacuated envelope indicated at 14. The envelope has two coaxial output leads 16 designated "+ terminal" and 17 designated "− terminal". For class B operation the harmonic frequencies associated with the half sinusoid waveform are antisymmetric and thus cancel via the bridging capacitor 13. Only the fundamental frequency component is symmetric so that the fundamental component of the RF current therefore is coupled to the load via the output terminals 16 and 17. More specifically the output leads 16 and 17 are connected to the load impedance $Z_L$ through bandshaping networks 18 and 19, impedance transformer networks 21 and 22 and dc blocking capacitors 23 and 24. The common point of the two capacitors 23 and 24 is one terminal of load $Z_L$ and the other terminal the common ground 12. In practice, however, the load $Z_L$ may be divided into two portions and later added in parallel to provide $Z_L$. The passband of the circuit is set by the bandshaping networks 18 and 19 and the impedance transformer networks 21, 22. The dc voltage sources $V_{cc}$ are tied together at the common ground point and to one terminal of the load $Z_L$. Their other terminals are coupled through RF choke coils to output line 16 and 17. The dc voltage sources, of course, provide a reverse bias across the diodes in a manner well-known in the art.

As discussed above, the dc blocking capacitors 23, 24 prevent the flow of dc current through the radio frequency output circuit $Z_L$. Since the blocking capacitor function has now been physically separated from the bypassing function these capacitors can be relatively small since blocking is accomplished at a high impedance level and the currents flowing are smaller because of the impedance transformer ratio. Similarly, the bypass capacitor 13 can be optimized to bypass the even harmonics. In particular, the magnitude of the total capacitance required by the bypass capacitor is greatly reduced. Thus even though, as is obvious from comparison to FIG. 1, that this capacitor must have twice the voltage breakdown capability, this is more than balanced by the reduction of total capacitance. As discussed above, the bypass capacitors must be located physically close to the diode target assembly to minimize propagation time. At frequencies above 200–300 MHz this usually requires a location inside the vacuum envelope. Thus, a reduction in total capacitance and size greatly simplifies the target geometry.

Figure 3:
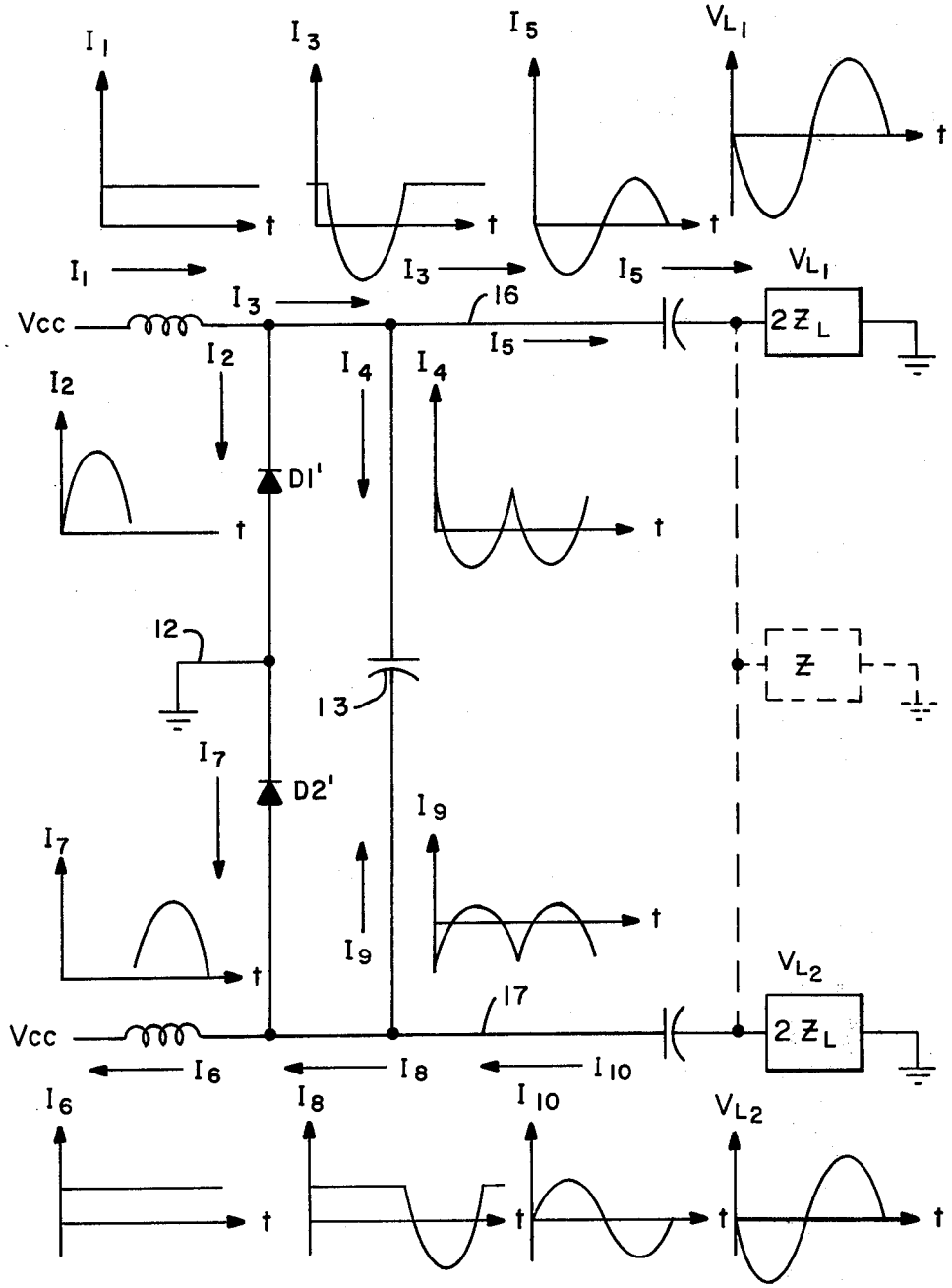
FIG. 3 is a simplified schematic circuit diagram of FIG. 2 along with various current waveforms occuring in the circuit.

FIG. 3 illustrates more clearly the operation of the circuit of FIG. 2 where the current waveforms in the various branches of the circuit are diagrammed over one radio frequency cycle. $I_1$ and $I_6$ are the dc currents flowing in the bias supply circuits. Half sine wave currents which flow through the diodes during alternate half cycles due to electron bombardment are shown as $I_2$ and $I_7$. The current waveforms must, of course, add up to zero at each node in the circuit. From inspection it can be seen that the waveform in each output leg 16 and 17, respectively $I_5$ and $I_{10}$ are strictly sinusoidal and thus the current waveforms lead to voltage waveforms at the output which are in-phase and can be added directly. The current flowing in the harmonic bypass capacitor 13 is shown as the components $I_4$ or $I_9$. The illustrated waveform ($I_4$ or $I_9$) has no dc component and a fundamental frequency which is twice the frequency of the injected current waveform which drives the diodes. Thus, this illustrates the even harmonic bypass capability of capacitor 13.

The upper and lower halves, 16 and 17 of the circuit are designed to work into a load impedance which is actually twice the output load impedance $Z_L$. They are designated $2Z_L$. However, these effectively combine, as shown in dashed lines, to give the final effective load impedance of $Z_L$. The output voltage is, of course, the same for the combined or separate circuits. However, since the combined circuit works into one-half of the impedance level, this represents twice the output power.

Figure 4:
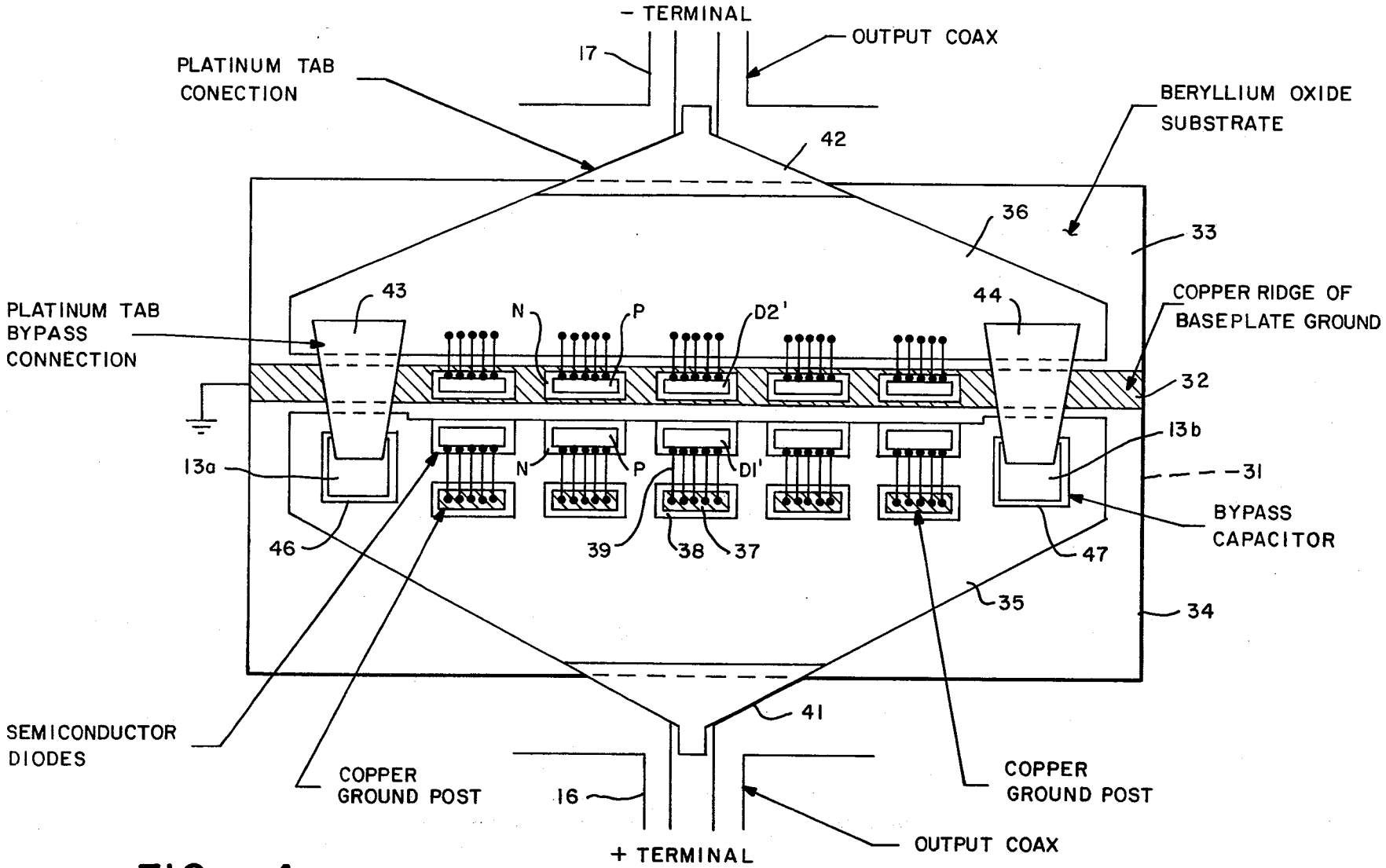
FIG. 4 is a front view showing one embodiment of the semiconductor target assembly of the present invention showing one embodiment thereof.

FIG. 4 shows the target layout of one embodiment of the five diode pair array and includes a copper base plate 31 (not shown) with a raised ridge 32 which as illustrated is slightly off center with respect to two rectangular beryllium oxide substrates 33 and 34 which are bonded to the copper base plate. Beryllium oxide is, of course, an insulator. The top surfaces of the beryllium oxide 33, 34 lie in the same plane as the copper ridge 32. The copper base plate is the common ground of the circuit. The diodes D1' and D2' are bonded in five pairs as illustrated one diode being bonded to the copper ridge 32 and the other to substrate 34 which has been metallized as indicated by the triangular metallization pattern 35. Similar metallization 36 is formed on substrate 33. The diodes of each pair are separated with a laser scriber.

Both the diodes D1' and D2' are of the type as illustrated in the above patent and consist of an n type substrate into which a p type region is diffused. In the case of the diode D1' the n type substrate is bonded to the metallization 35, also forming an electrical connection, and the p type area is connected by a wire bonding indicated at 39 to copper ground posts 37 which are formed on the copper base plate 31. Thus, as indicated at 38 there is a gap of the metallization layer 35 around the copper ground post 37 in order to isolate it. The diodes D2' have their n type regions directly bonded to the ridge 32 with the p type regions being wire bonded to metallization 36. Platinum tab connections 35 and 36 complete the connection to coaxial outputs 16 and 17. The bypass capacitors **13*a* and 13*b* are of the order of 500 picofarads each or since they are in parallel total 1,000 picofarads. They are bonded at the same time as the diodes. The top plate of each capacitor is connected by means of platinum tab bypass connections 43 and 44 to metallization 36 and the other plate is, of course, the adjacent area of metallization 34; the larger rectangles 46 and 47** indicate insulation between the two plates in order to form the capacitors.

Figure 5:
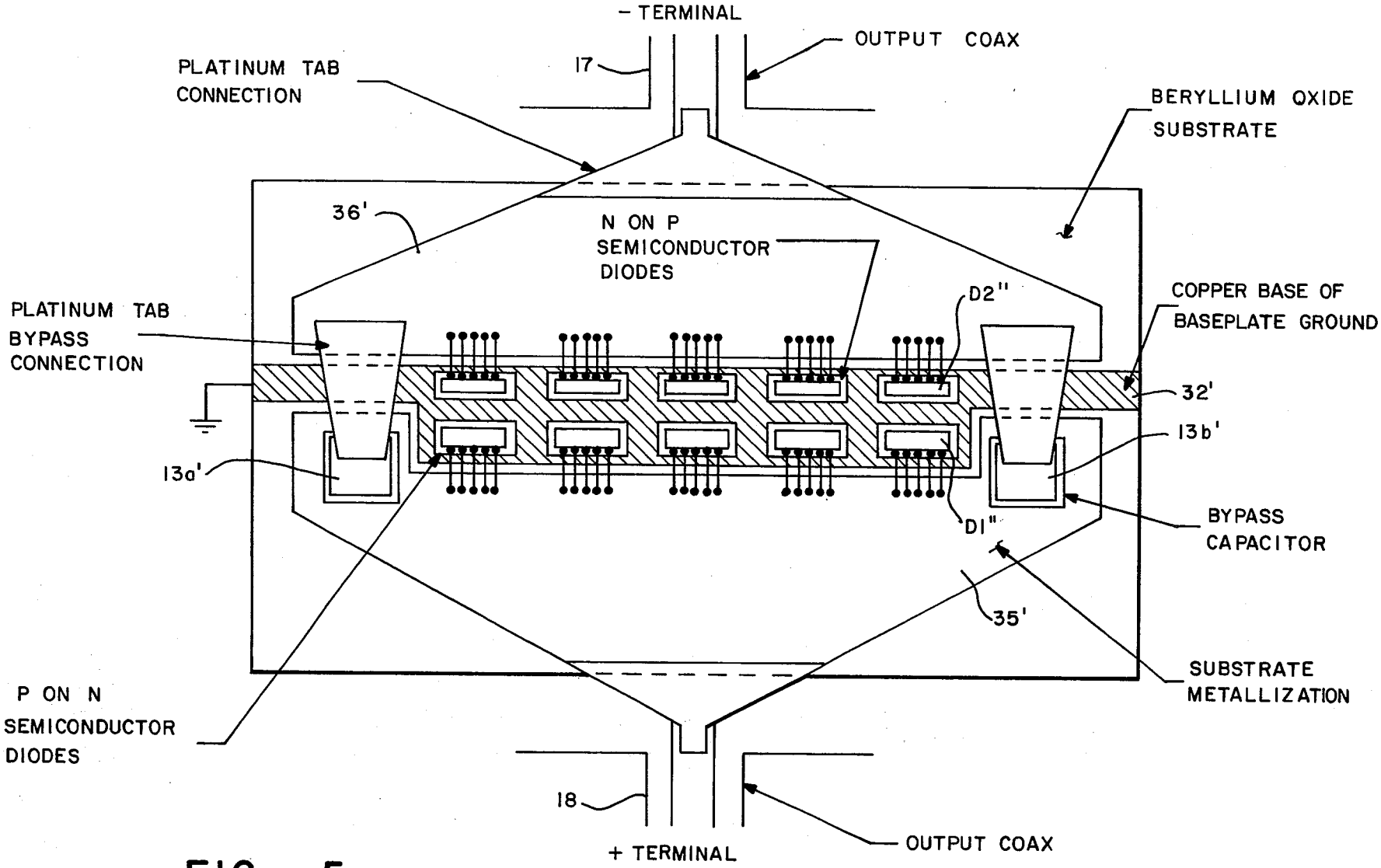
FIG. 5 is a front view of a semiconductor target assembly showing another embodiment.

FIG. 5 illustrates an alternative construction where the diodes are complementary in nature. The diodes D2'' have an n type substrate with a p type diffusion region and the diodes D1'' have a p type substrate with an n type diffusion area. This considerably simplifies the structure of FIG. 4 so that an enlarged copper ridge 32' which is of unitary construction serves as a common ground. The ridge may now be used as a common bonding point, from both electrical and mechanical standpoints, for the n substrate of diodes D2'' and the p substrate of diode D1''. The other regions of the diodes are wire bonded to metallizations 36' and 35'. Bypass capacitors are provided at **13'*a* and 13'*b*. Since in this construction the diodes are directly bonded to the copper baseplate via ridge 32'**, the high conductivity of copper provides better diode cooling. Therefore, operation at high power levels is possible.

With the construction of the present invention in its inverted class B format where the common junction of the diodes is returned directly to ground, the operation of the microwave device is significantly improved in that multioctave operation, for example, from 10 to 350 MHz is possible. Moreover, the target construction is simplified due to both the reduction in physical size of the radio frequency bypass capacitors and the complementary construction illustrated in FIG. 5.

What is claimed is:

1. An electron bombarded semiconductor device having an evacuated envelope, an electron gun positioned at one end of said envelope to project an electron beam along said envelope in a predetermined path, and means responsive to an input signal for deflecting said beam from said path, the invention comprising: a target within said envelope comprising a pair of spaced semiconductor diode devices each having first and second regions of opposite conductivity types forming a p-n junction with a region adapted to receive said beam, said beam impinging between said devices when it is in said predetermined path and impinging a region of one or the other of said devices when deflected responsive to said input signal, said target including a common ground and means for connecting one region of each of said devices, but of opposite conductivity type, to said common ground; a load having one terminal connected to said common ground and the other ac coupled to the other regions of said semiconductor diode devices and means for applying a unidirectional voltage between said common ground and said other regions to reverse bias said diode devices.

2. A device as in claim 1 where said target includes bypass capacitor means connected across said other regions of said diode devices.

3. A device as in claim 1 together with capacitor means, exterior to said envelope, connected between said other terminal of said load and said other regions of said diode devices for blocking said unidirectional voltage from said load.

4. A device as in claim 1 where said diode devices are of complementary construction said target including a unitary metal baseplate ground to which regions of opposite conductivity of said diode devices are mechanically and electrically attached.

* * * * *